United States Patent [19]

Heath

[11] 4,101,125

[45] Jul. 18, 1978

[54] ADJUSTABLE TENNIS RACKET

[76] Inventor: George Heath, 2449 Fairway Dr., Vero Beach, Fla. 32960

[21] Appl. No.: 699,810

[22] Filed: Jun. 25, 1976

Related U.S. Application Data

[63] Continuation-in-part of Ser. No. 631,310, Nov. 12, 1975, abandoned.

[51] Int. Cl.[2] ..... A63B 49/08

[52] U.S. Cl. ..... 273/75; 273/73 J

[58] Field of Search ..... 273/670 A, 670 DB, 73 R, 273/73 J, 75, 80 R, 80 D, 80.1, 79, 81 R, 81 B, 81 C, 81 D, 81.2, 81.3, 81.5, 81.6, 183 D, 193 B; 145/61 G; 403/108, 109, 111, 116, 348, 349, 378, 379; 15/144 R; 294/57

[56] References Cited

U.S. PATENT DOCUMENTS

| | | | |
|---|---|---|---|
| 1,903,576 | 4/1933 | Skeel et al. | 403/116 X |
| 2,044,567 | 6/1936 | Daday | 273/81 C |
| 2,091,512 | 8/1937 | Marsh | 273/81 C |
| 2,225,839 | 12/1940 | Moore | 273/81 C |
| 3,203,697 | 8/1965 | Berzatzy | 273/75 |
| 3,224,781 | 12/1965 | Hutchison | 273/81.2 X |
| 3,360,266 | 12/1967 | Wathen | 273/79 X |
| 3,377,966 | 4/1968 | Bates et al. | 403/108 X |
| 3,401,951 | 9/1968 | Bloom | 403/116 X |
| 3,534,960 | 10/1970 | Hanks | 273/75 |
| 3,544,140 | 12/1970 | Langheck | 273/80.1 X |
| 3,601,399 | 8/1971 | Agens | 273/79 |
| 3,834,714 | 9/1974 | Smolinski | 273/81 C X |
| 3,905,598 | 9/1975 | Ballog | 273/75 |
| 3,982,841 | 9/1976 | Endzweig | 403/348 X |

FOREIGN PATENT DOCUMENTS

| | | | |
|---|---|---|---|
| 437,239 | 2/1912 | France | 294/57 |
| 942,075 | 4/1956 | Fed. Rep. of Germany | 273/73 J |
| 2,444,304 | 3/1976 | Fed. Rep. of Germany | 273/75 |
| 2,458,572 | 6/1976 | Fed. Rep. of Germany | 273/75 |
| 2,458,581 | 6/1976 | Fed. Rep. of Germany | 273/75 |
| 326,877 | 6/1935 | Italy | 273/73 J |
| 409,325 | 4/1934 | United Kingdom | 273/81 B |

*Primary Examiner*—Richard J. Apley

*Attorney, Agent, or Firm*—Clarence A. O'Brien; Harvey B. Jacobson

[57] ABSTRACT

A racket for striking a ball or other projectile employed in playing games, such as tennis, which includes a head, an elongated handle, a hand grip mounted on the outer end of the handle having the capabiity of limited angular displacement between predetermined positions relative to the head about an axis extending longitudinally of the handle and a positive lock provided between the hand grip and handle which requires a dual relative motion to adjust the handle and hand grip in angular displacement in relation to each other. The angular displacement is permitted by an arcuate slot provided in the hand grip and a radial pin in the handle with the slot including longitudinally extending end portions receiving the pin for locking the pin in one of the end portions of the slot for securing the hand grip in predetermined angular displacement in relation to the head of the racket. As an alternate arrangement, the hand grip includes a plurality of circumferentially spaced arcuate slots in which the longitudinally extending end portions are spaced apart at different predetermined distances and the pin is movable radially for engagement with and disengagement from the slots to enable the angle through which relative angular displacement occurs between the racket head and hand grip to be selected by a player.

6 Claims, 5 Drawing Figures

ADJUSTABLE TENNIS RACKET

CROSS REFERENCE TO RELATED APPLICATION

This application is a continuation-in-part of my copending application Ser. No. 631,310, filed Nov. 12, 1975, for Adjustable Tennis Racquet, now abandoned.

BACKGROUND OF THE INVENTION

1. Field of the Invention

The present invention generally relates to game rackets and more particularly a racket in which the racket head and grip are angularly displaceable about a longitudinal axis of the handle with the racket head and grip being positively locked in their relative positions with the angular displacement requiring dual motion, namely, relative longitudinal movement and relative rotational movement between the hand grip and racket head.

2. Description of the Prior Art

The prior art cited in the parent application, U.S. Ser. No. 631,310, relates generally to this subject matter with Hanks, 3,534,960, providing a structure capable of angular displacement between the hand grip and head of the racket.

SUMMARY OF THE INVENTION

In playing tennis or similar games the racket permits striking the ball with either a forehand or a backhand stroke. To best execute each of these strokes, it is desirable for the player to utilize a different grip on the racket for the backhand stroke than for the forehand stroke. The specific manner of gripping the racket for these strokes is well known to those skilled in the art and is disclosed in detail in my parent application, the disclosure of which is incorporated herein by reference thereto.

It is an object of the present invention to provide a game racket constructed in a manner to maintain as near as possible a perpendicular racket face at impact with the game ball with the handle being rotated rather than the hand.

Another object of the invention is to provide a racket in accordance with the preceding object in which the hand grip and handle are interconnected by a structure which requires dual motion between the handle and hand grip to angularly displace the racket head and hand grip about the longitudinal axis of the handle with the components being positively locked in the displaced positions.

A further object of the invention is to provide a game racket in accordance with the preceding objects in which the hand grip is provided with a plurality of circumferentially spaced structures having different displacement limitations thereby enabling variation in the angular displacement characteristics between the hand grip and handle to be obtained by individual players.

Still another object of the invention is to provide an adjustable game racket in accordance with the preceding objects in which the handle is provided with a spring loaded, radially movable pin engageable with one of a plurality of circumferentially spaced slot-like structures provided in the hand grip to enable the pin to be associated with a selected slot-like structure in which the slot-like structure includes a pair of remotely disposed longitudinally extending end portions receiving the pin for retaining the handle and hand grip in angular displaced relationship, together with spring means retaining the pin in the longitudinal end portions of the slot structures, thus requiring dual motion of the handle and hand grip in relation to each other in order to displace the pin from one end portion of the slot structure to the other end portion.

Still another important feature of the present is the construction of the hand grip of conventional tubular stock together with attachable longitudinal strips to form a base for the spirally wound hand grip covering in order to produce a polygonal hand grip, preferably hexagonal in over-all configuration.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
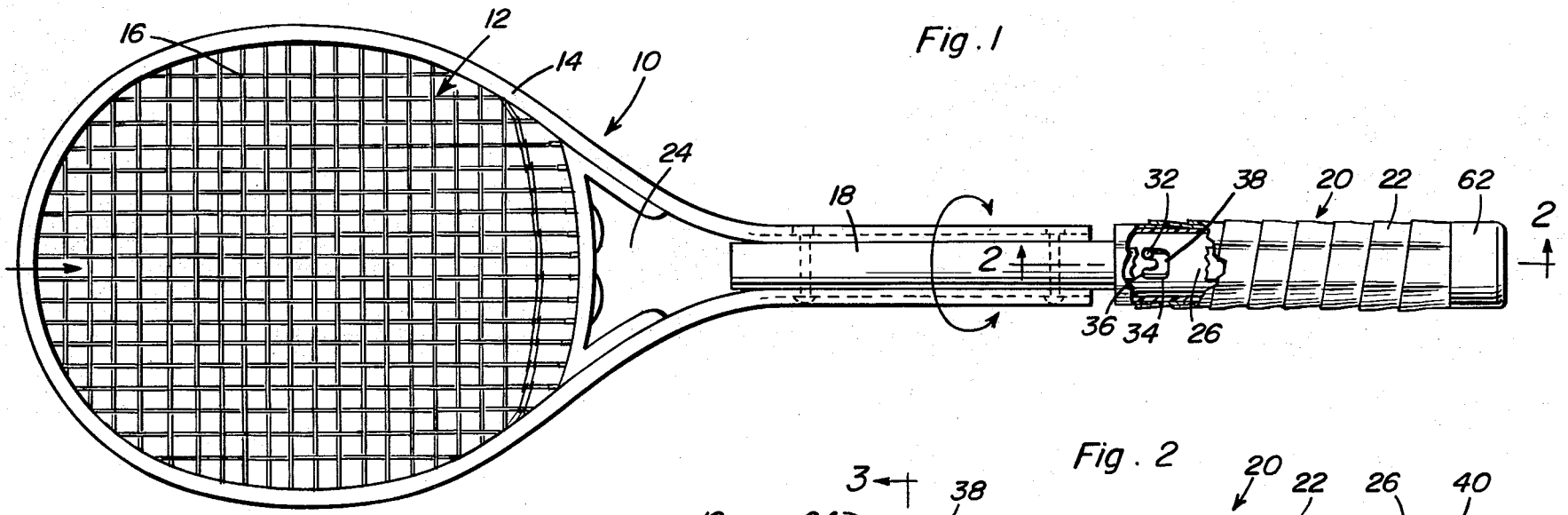
FIG. 1 is a side elevational view of the adjustable tennis racket of the present invention with a portion of the hand grip covering omitted for illustrative purposes.
Figure 2:
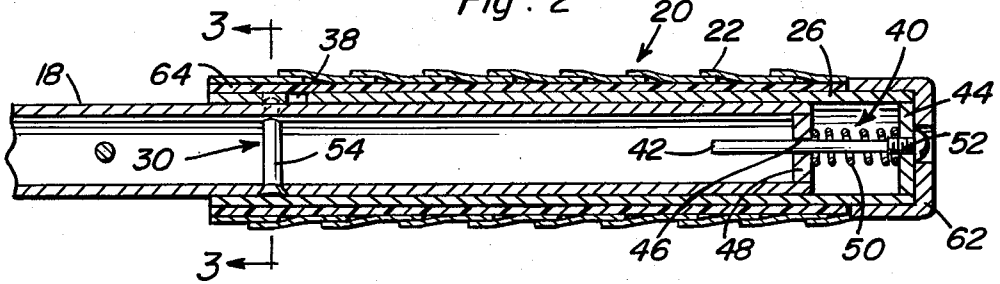
FIG. 2 is a longitudinal, vertical sectional view, on an enlarged scale, taken substantially on a plane passing along section line 2—2 of FIG. 1, illustrating further structural details of the handle and grip.

Referring now to the drawings, a game racket incorporating the present invention therein is designated by numeral 10 and is used in playing such games as tennis, badminton, squash, paddle ball, and the like. The racket 10 includes a head portion 12 consisting of a frame 14 which may be made of aluminum, steel, chrome, or other lightweight metal, graphite, plastic, fiber glass, wood, or the like, having a desired shape such as shown with strings 16 supported by the frame 14 in any of a variety of well-known ways. The strings 16 may be of nylon, gut, metal, or the like, and are supported in the frame to define two opposite faces or striking surfaces for the game ball or projectile. An elongated handle 18 generally formed integrally with frame 14 or which may be separately secured thereto, and which may be made of any suitable material extends outwardly of frame 14. The end of the handle remote from the frame comprises a grip 20. A conventional leather, plastic, or rubber grip covering 22 is spirally wound about at least a portion of the grip to permit the racket to be comfortably and securely grasped by the player. Although the grip of a racket is conventionally integral with the handle, in the present invention, grip 20 is angularly displaceable relative to the handle 18 in order that the vertical angle of the head 12 relative to the ground surface can be changed in a manner described hereinafter.

In the embodiment illustrated in the drawings, the frame 14 is made of metal tubing and shaped to define an elliptical, strung ball striking racket head. The handle 18 is an elongated tubular member having a cylindrical exterior which is secured to the legs of frame 14 by any suitable means, such as, bolts extending therethrough and secured in place by appropriate countersunk nuts. The area at which the generally elliptical frame 14 meets the generally tubular handle is referred to as the throat 24 of the racket with all of the aforementioned structure, except for the angular displacement capability representing conventional tennis racket structure.

Telescoped over and rotatable in relation to the tubular handle 18 along a portion of the length thereof remote from the head 12 is a cylindrical sleeve 26 with the outer surface of the tubular handle 18 closely received in the inner surface of the sleeve 26 to prevent relative lateral movement while permitting relative longitudinal movement and relative rotational movement or angular displacement about the longitudinal axis of the handle 18 and sleeve 26.

A transversely extending pin assembly 30 is disposed in the tubular handle 18 adjacent the inner end portion of the sleeve 26 with the pin assembly including a diametrically disposed pin 32 which can be moved radially inwardly and outwardly in relation to the tubular handle 18. The outer end of the pin 32 is received in a slot 34 formed in the sleeve 26 in which the slot 34 is substantially U-shaped in configuration as illustrated in FIG. 1 and which includes a pair of circumferentially spaced longitudinally disposed, generally parallel end portions 36 interconnected by an arcuate portion 38 in which the end portions 36 extend towards the head 12. In order for relative rotation to occur between the handle 18 and the sleeve 26, the handle and sleeve must be moved longitudinally in relation to each other to move the pin 32 from the end portion 36 into the arcuate portion 38 and then rotate the handle and sleeve in relation to each other about the longitudinal axis thereof. To removably retain the pin 32 in the end portion 36 of the slot 34, a spring assembly 40 interconnects the ends of the handle 18 and sleeve 26 remote from the head. The spring assembly 40 includes an elongated pin or rod 42 fixedly but removably secured to an end wall 44 in the sleeve 26 and slidably received through an opening 46 in the end wall 48 in the handle 18. A compression coil spring 50 is interposed between the end walls 48 and 44 to bias the end walls apart and resiliently retain the pin 32 in the end portion 36 of the slot 34. The rod 42 may be screw threadedly connected to the end wall 44 as by a screw threaded connection 52 to enable removal thereof when necessary.

Figure 3:
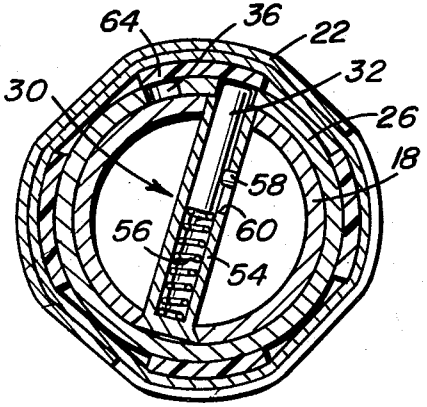
FIG. 3 is a transverse, sectional view, on an enlarged scale, taken substantially upon a plane passing along section line 3—3 of FIG. 2, illustrating further structural details of the hand grip and the spring loaded lock pin.

As illustrated in FIG. 3, the pin assembly 30 includes a diametrically disposed tubular guide 54 which slidably receives the pin 32 with a spring 56 biasing the pin 32 radially outwardly of the handle 18. To limit movement of the pin 32, it is provided with a lateral projection 58 slidable in a longitudinal slot 60 in the tubular guide 54. Thus, by taking a suitable instrument and engaging the outer end of the pin 32 and pushing it inwardly, the pin 32 may be disengaged from the slot 34 and the sleeve 26 may be then removed from the handle 18, thus enabling assembly and disassembly of the sleeve 26 when desired.

The grip covering 22 is in the form of a continuous spirally wound strip having one end thereof retained in position by a cap 62 or the like and the other end secured to the sleeve 26 in any suitable manner, such as by a hook structure or other connecting means, with the covering 22 normally concealing the slot 34 and the pin 32 since once the device has been assembled, it is not usually necessary to disassemble it.

Inasmuch as the sleeve 26 is cylindrical on the exterior thereof which enables stock components to be employed, the shape of the grip covering 22 is altered from cylindrical by a plurality of longitudinally extending strips 64 which are in the form of magnetic tape strips that are commercially available and will be magnetically retained in place, although such strips may also be provided with an adhesive coating on the inner surface thereof. As illustrated, four of the tape strips are used which convert the generally cylindrical configuration of the sleeve 26 to a generally octagonal configuration for the hand grip which is desirable to customize the "feel" of the racket handle to the individual player.

Figure 5:
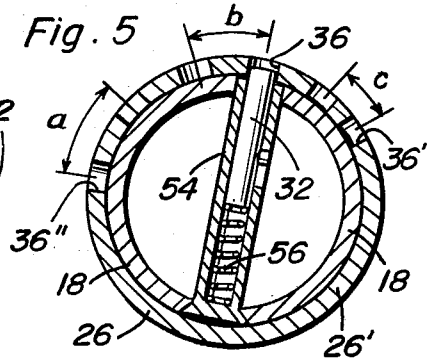
FIG. 5 is a transverse, sectional view, on an enlarged scale, taken substantially upon a plane passing along section line 5—5 of FIG. 4, illustrating further structural details of this construction.
Figure 4:
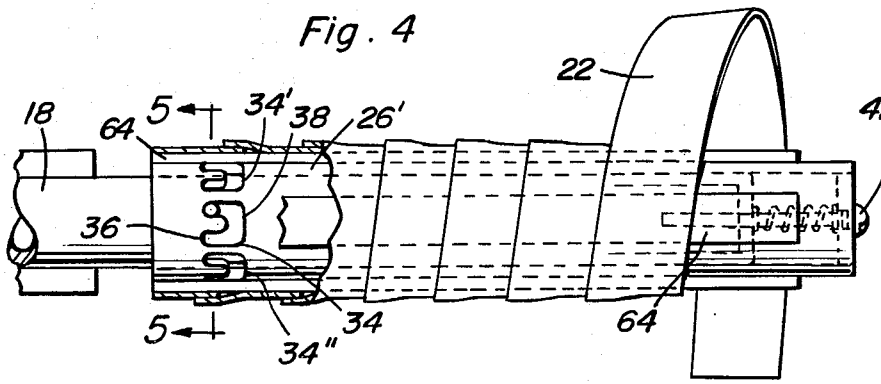
FIG. 4 is a fragmental elevational view of a portion of the hand grip illustrating an arrangement in which multiple slot-like structures are provided in the grip.

FIGS. 4 and 5 illustrate exactly the same structure, except that in this construction, three circumferentially spaced slots 34, 34' and 34" are utilized so that by unwinding the grip covering 22, the pin 32 may be depressed and the sleeve 26 rotated so that the pin 32 may be selectively engaged with one of the three slots. As illustrated, the longitudinal end portions 36 of each of the slots are spaced apart a different distance with this angular displacement being illustrated in FIG. 5 and designated by angles a, b and c. Thus, an individual player may preset the angular displacement which will occur between the head 12 and grip 20 when the dual motion adjustment is accomplished by moving the handle 18 and sleeve 26 longitudinally toward each other while compressing the spring 50 and at the same time rotating the head 12 and handle 18 in relation to the sleeve 26 and then releasing the longitudinal force which moved the head 12 toward the sleeve 26.

Due to the substantially parallel relation of the end portions 36 of the slots which receive the pin 32, unintentional angular displacement of the racket head relative to the grip will be precluded, since there is a definite dual force or motion which must be used in order to angularly displace the racket head relative to the grip. The player must physically move his hands together with one hand on the grip and the other engaging the outer edge of the head to overcome the spring 50 and then twist one hand in relation to the other, thus pivoting the head 12 about the longitudinal axis of the handle and sleeve, so that the head will be angularly displaced in relation to the grip. While the spring 50 is easily compressed and offers no substantial resistance, it is adequate to maintain a positive lock for the grip 20. With this arrangement, assuming the grip is engaged by the right hand, the dual motion is accomplished by movement of the left hand in engagement with the outer end of the head 12 of the racket, thus leaving the player's hand immovable in relation to the grip 20, thereby enabling the player to more effectively maintain gripping relation to the grip 20. With this arrangement, a perpendicular racket face is maintained. It is usually not necessary to rotate during a point since it can be preset to the backhand side and left there throughout the point. For an eastern grip player, this has the effect of changing to a western grip but without the player having changed his grip on the racket from his customary style. An opponent cannot tell if he is serving to a preset backhand adjusted preference and thus cannot be sure how your stroke will strike the ball as he has no way of knowing which set position you are using. Usually, a player will only change during a point when rallying from deep behind the base line when there is usually plenty of time.

While the structure disclosed has been found acceptable, other types of structures may be employed for enabling retraction of the pin, exerting relative longitudinal forces on the sleeve and handle and converting the cylindrical configuration of the sleeve to an octagonal or other polygonal configuration.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A game racket comprising a racket head adapted for striking a game projectile such as a tennis ball and having substantially planar, generally parallel opposite side striking faces, an elongated handle projecting from said head, hand grip means rotatably mounted on the outer end of said handle for limited angular displacement relative to said head and handle about an axis extending longitudinally of said handle between two predetermined angularly displaced positions, said first position being such as to present said racket head at an appropriate vertical angle relative to said projectile and the ground for forehand striking of said projectile and, without changing the grip on said grip means, said second position being such as to present said racket head at an appropriate vertical angle relative to said projectile and the ground for backhand striking of said projectile, and means interconnecting the handle and hand grip means to positively lock the hand grip means and handle in said adjusted angularly displaced positions, said interconnecting means being releasable during play of a point in response to longitudinal movement of the racket head toward the hand grip means in a manner similar to forces exerted on the head when shifting between a forehand and backhand stroke when using a racket with a rigidly interconnected head, handle and hand grip means to enable angular adjustment of the racket head and handle relative to the hand grip means without moving or releasing any part of the hand in gripping engagement with the hand grip means, and a spring assembly interconnecting the handle and hand grip means to releasably retain the handle and grip means in locked position.

2. The structure as defined in claim 1 wherein said means interconnecting the handle and hand grip means includes a slot and pin construction with the slot including a circumferential arcuate portion and a pair of spaced end portions communicated therewith in which the end portions are disposed longitudinally in relation to the handle for receiving the pin thereby requiring relative longitudinal movement between the handle and hand grip means in order to register the pin with the arcuate portion of the slot to enable relative movement of the handle and hand grip means about a longitudinal axis.

3. The structure as defined in claim 2 wherein said spring assembly includes spring means interconnecting the handle and grip means for biasing the pin into the longitudinally disposed end portions of the slot, thus requiring physical exertion of force by the two hands of a player, one gripping the hand grip means and one engaging the head in order to angularly displace the head in relation to the hand grip means without altering the gripping characteristics between the hand of the player and the hand grip means.

4. The structure as defined in claim 3 wherein said hand grip means is in the form of a tubular sleeve with said slot being disposed in said sleeve adjacent an inner end thereof, said pin being diametrically disposed in relation to the handle and spring biased radially outwardly for engagement with the slot.

5. The structure as defined in claim 4 together with additional circumferentially extending slots spaced circumferentially of each other with each slot having longitudinal end portions spaced circumferentially apart different distances to enable the pin to be selectively engaged with one of the slots for varying the degree of angular displacement between the head and hand grip means when the pin moves from one longitudinal end portion to the other of a slot.

6. The structure as defined in claim 4 wherein said hand grip means includes a tubular sleeve having a cylindrical external surface, a plurality of longitudinal strips on said sleeve disposed in circumferentially spaced relation, and a spiral grip covering wrapped around the strips and sleeve to form a grip of generally polygonal configuration.

* * * * *